427-372.2 SP
10/15/85 XP 4,546,553

United States Patent [19]

Best

[11] Patent Number: 4,546,553

[45] Date of Patent: Oct. 15, 1985

[54] RADIANT WALL OVEN AND PROCESS OF DRYING COATED OBJECTS

[76] Inventor: Willie H. Best, 18C The Heritage, Columbia, S.C. 29203

[21] Appl. No.: 519,859

[22] Filed: Aug. 3, 1983

Related U.S. Application Data

[60] Continuation-in-part of Ser. No. 282,531, Jul. 13, 1981, Pat. No. 4,426,792, which is a continuation of Ser. No. 104,339, Dec. 17, 1979, abandoned, which is a division of Ser. No. 916,214, Jun. 16, 1978, Pat. No. 4,235,023.

[51] Int. Cl.[4] ..... F26B 3/28; F26B 23/10

[52] U.S. Cl. ..... 34/39; 34/68; 34/243 C; 118/642; 427/372.2

[58] Field of Search ..... 427/372.2, 444; 118/642, 643; 34/4, 39, 40, 41, 68, 243 C; 432/209, 212, 213, 148

[56] References Cited

U.S. PATENT DOCUMENTS

| | | | |
|---|---|---|---|
| 724,826 | 4/1903 | Dwight | 432/212 |
| 1,464,348 | 8/1923 | Ayres | 34/212 |
| 2,262,057 | 11/1941 | Shaw . | |
| 2,376,174 | 5/1945 | Munning et al. | 34/213 |
| 2,790,250 | 4/1957 | Giroud . | |
| 3,016,442 | 1/1962 | Brach | 34/4 |
| 3,259,995 | 7/1961 | Powischell | 34/54 |
| 3,277,948 | 10/1966 | Best . | |
| 4,416,068 | 11/1983 | Nilsson et al. | 34/39 |

*Primary Examiner*—Larry I. Schwartz
*Attorney, Agent, or Firm*—Newton, Hopkins & Ormsby

[57] ABSTRACT

Radiant curved walls enclose opposite sides of a central heating chamber within which objects to be heated and dried are placed or passed along a path of travel. An insulated outer housing surrounds the radiant walls and defines, therewith, a pair of outer heating chambers. Heaters, carried by the outer housing, heat the air in the outer chamber and impellers in the outer chamber circulate that air so that it heats the radiant walls. Vents at the bottom portions of the radiant walls release air from the outer chamber to the inner chamber and an exhaust fan removes the air from the inner chamber. Radiation from the radiant walls heat and dry the objects, more than one-half the radiation being of a wave length of 5 microns or greater.

23 Claims, 12 Drawing Figures

MONOCHROMATIC EMISSIVE POWER VS. WAVE LENGTH
(APPARENT EMISSIVITY = 1)

RADIANT WALL OVEN AND PROCESS OF DRYING COATED OBJECTS

CROSS REFERENCE TO RELATED APPLICATIONS

This application is a continuation-in-part of my copending application Ser. No. 282,531, filed July 13, 1981 which was a continuation of application Ser. No. 104,339, filed Dec. 17, 1979 now abandoned which was a division of application Ser. No. 916,214, filed June 16, 1978, now U.S. Pat. No. 4,235,023, issued Nov. 25, 1980 for HIGH HEAT TRANSFER OVEN.

BACKGROUND OF THE INVENTION

1. Field of the Invention

This invention relates to a Radiant Wall Oven and Process of Drying Coated Objects and is more particularly concerned with an oven having radiant walls, radiant heat transfer and turbulent air for convective heat transfer and to a process of using the same.

2. Description of the Prior Art

Infra-red energy has been used for years as a form of energy to cure and dry coatings. In most designs of infra-red ovens, gas burners or electric elements were usually used to produce the infra-red radiation. These burners or electric elements usually operated in a temperature range from 1200° F. to 3000° F. A typical gas fired infra-red burner of this type is described in Best U.S. Pat. No. 3,277,948 for RADIANT BURNER UTILIZING FLAME QUENCHING PHENOMENA. Because of the high energy levels generated at these temperatures, the burner surface area (radiating emitting surface) was usually small compared to the total area of the oven enclosure or compared to the absorbing surface area of the processed parts, material or objects which were to be heated and dried. Usually reflective material was mounted between the burners or electric elements to reflect the radiant energy that was not absorbed by the processed parts or material. As the reflectors aged and became soiled their reflective qualities decreased and the oven efficiency rapidly decreased.

One of the features of this invention overcomes this problem by providing a method and apparatus in which large surfaces, encompassing the entire tunnel of travel of the objects, can radiate; thereby eliminating the need for any reflective surfaces between emitting surfaces.

In the past, the automotive industry has usually employed, for painting its automobiles, lacquers and enamels, which air dried to a tacky free condition in several minutes. Recently, however, such automobile manufacturers have converted to acrylic enamels which stay wet substantially longer, thereby giving the paint more opportunity to be exposed to dirt in the ambient air. In substantially any type of oven, there is always dirt within the oven cavity which will be blown around by the air and may settle on the freshly painted, wet or tacky surface. To minimize the likelihood that dirt will reach the surface of the vehicle, the present invention will dry an acrylic paint, such as that paint used in the automobile industry, to a tacky-free condition in a relatively short period of time, namely in approximately six minutes, while maintaining the painted object in a substantially cleaner atmosphere and in a zone of air quiescence, thereby minimizing the likelihood of the collection of dirt and dust on the paint.

SUMMARY OF THE INVENTION

Briefly, in one embodiment of the apparatus, a pair of opposed concaved radiant emitter walls, which are coated with a material possessing high emissivity characteristics, direct radiant energy, a majority of which is of wavelengths greater than 5 microns, toward a vertical plane along a longitudinal center line of the oven. The curvatures of the opposed walls are usually symmetrical, each curving generally about transversely horizontal axes, spaced above the floor so as to concentrate the radiation, as much as practical, to uniformly cure paint on successive contoured objects moved linearly along the centerline in a central heating chamber. The curved portions, which form the radiant emitter elements of the walls, have linear longitudinal dimensions and curvilinear vertical dimensions so as to direct the radiation toward the imaginary tunnel generated by the successive objects as they pass through the central chamber.

An outer insulated housing surrounds the outer portions of the radiant walls, to define a pair of outer side chambers, in which heated air is circulated under turbulent conditions against the back sides of the radiant walls. Heaters and air impellers heat and circulate the air. An exhaust in the top of the housing, exhausts air from the inner or central chambers. Vents in the bottom portions of the radiant walls permit air from the outer chambers to pass into the central chamber and move upwardly along the coated walls for maintaining the coating at elevated temperatures. This air also dilutes the evaporated solvents released by the paint.

In a second embodiment, air impellers are installed in the roof of the housing so that the oven can be initially operated for radiant heat drying and then operated for combined radiant heat drying and tubulent convection heat drying. The oven is of modular construction and thus an oven of any reasonable length can be constructed.

Accordingly, it is an object of the present invention to provide a radiant oven which is inexpensive to manufacture, durable in structure and efficient in operation.

Another object of the present invention is to provide a radiant wall oven and process of drying coated objects in which successive objects are quite easily dried.

Another object of the present invention is to provide a radiant wall oven which will concentrate the maximum radiant intensity on an area through which objects to be heated and dried are passed.

Another object of the present invention is to provide an oven which will rapidly dry objects in a clean atmosphere.

Another object of the present invention is to provide an oven capable of rapidly heating and drying a freshly painted object while maintaining at a minimum the generation of bubbles and the collection of dust and dirt thereon.

Another object of the present invention is to provide an radiant oven and process of drying objects which will uniformly heat and dry successive objects quite rapidly.

Another object of the present invention is to provide a radiant oven which is capable of drying paint to a tacky free condition, without any appreciable air movement adjacent to the paint, which movement might deposit dirt carried by the air, on the paint and, thereafter, heat the object quite rapidly.

Another object of the present invention is to provide an apparatus and process for heating freshly painted objects so as to cure them using both radiation and convection heat transfer, without any appreciable danger of depositing particles of dirt on the object, when the object is in a tacky condition.

Another object of the present invention is to provide a radiant heat oven which will occupy very little space and which can be economically operated.

Another object of the present invention is to provide a radiant oven which is capable of being extended when additional capacity requires.

Other objects, features and advantages of the present invention will become apparent from the following description when taken in conjunction with the accompanying drawings wherein like characters of reference designate corresponding parts.

DESCRIPTION OF THE PREFERRED EMBODIMENTS

Figure 1A:
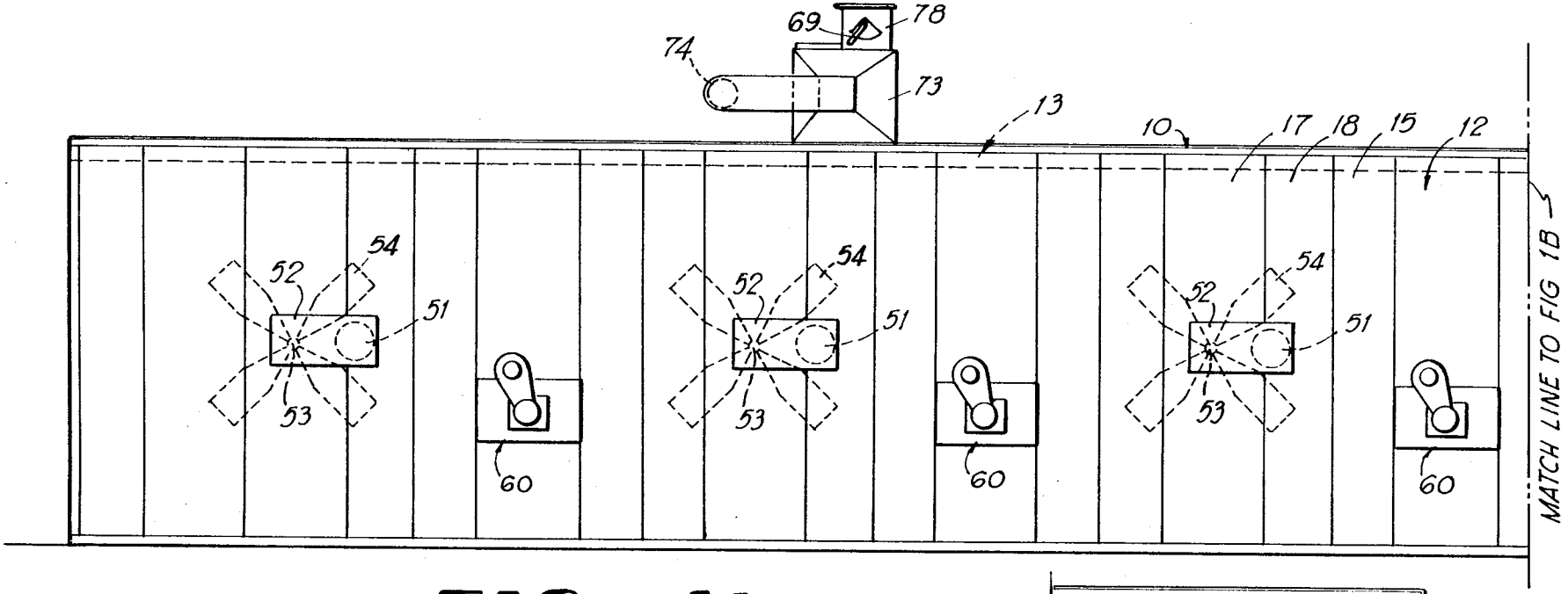
FIG. 1A is a side elevational view of a portion of a radiant wall oven constructed in accordance with the present invention.
Figure 1B:
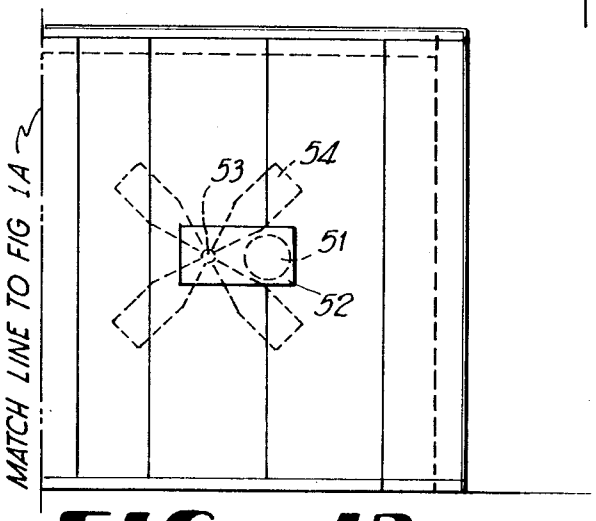
FIG. 1B is the remaining portion of the structure depicted in FIG. 1A.
Figure 2:
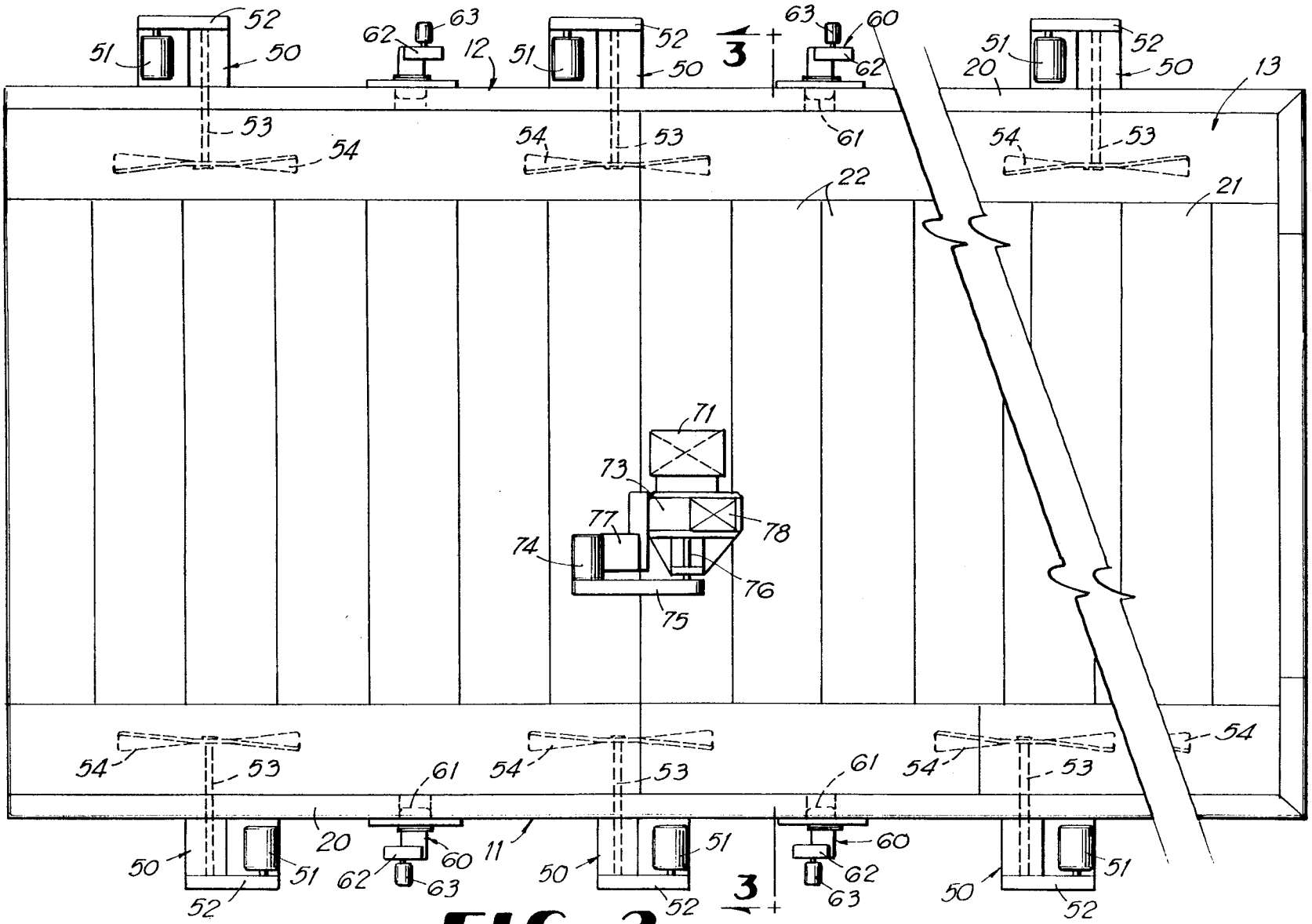
FIG. 2 is a top plan view, partially broken away, of the oven depicted in FIGS. 1A and 1B.

Referring now in detail to the embodiments chosen for the purpose of illustrating the present invention, numeral 10 in FIG. 1A through FIG. 3, denotes generally the housing of the radiant wall oven. This housing 10 is formed of spaced, opposed, parallel side panels 11 and 12 and a roof or top panel 13. In more detail, each of the side panels, such as panel 11, is made up of an outer wall, such as wall 15, and an inner wall, such as wall 16. These walls 15 and 16 are each made up of a plurality of vertically extending channel shaped members, such as members 17 and 18, which are arranged side by side so that they extend throughout the length of the side panels 12 and 13. Insulation material 19 is disposed between the parallel walls 15 and 16 and the perimetal edges of the walls 15 and 16 are joined by side plates 20, seen in FIG. 3, to enclose the insulation.

The top panel 13, is composed of an outer central wall 21 and an inner central wall **21*a* made up of juxtaposed transversely extending, channel members, such as members 22. Top insulation material 23 separates the two walls 21 and 21*a* while end plates, such as end plates 24, extend around the perimetal edges of the walls 21 and 21*a* to surround the top insulation material 23**.

Figure 3:
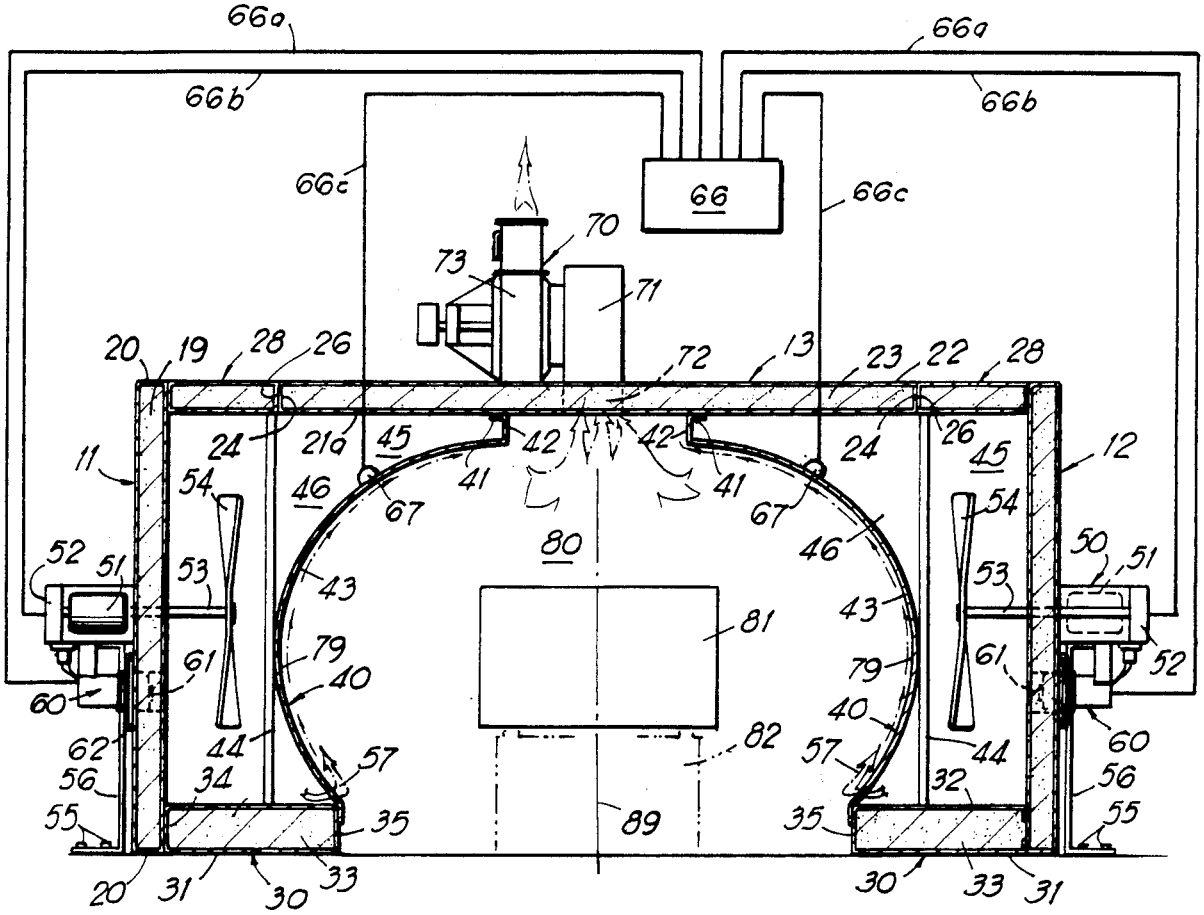
FIG. 3 is a vertical sectional view taken substantially along line 3—3 in FIG. 2.

Abutting the opposed longitudinally extended end plates 24 are additional side plates 26 of outer top plates 28 which extend outwardly from the longitudinal sides of central portion of top panel 13 to abut the upper edge portions of the inner walls, such as wall 16, as shown in FIG. 3. Thus, the top or roof panel 13 is supported by the side panels 11 and 12 to form a rectangular interior cavity. It will be understood that the particular shape of the housing 10 is not critical and other shapes can be employed.

Resting on the floor 29 are the lower ends of panels 11 and 12. Protruding inwardly from these lower end portions of the panels 11 and 12 are a pair of spaced, opposed, floor panels 30, seen in FIG. 3, which have bottom walls 31 and top walls 32 disposed in spaced parallel relationship, there being provided insulation material 33 between these walls 31 and 32. Side plates, such as plates 34 and 35, join the perimeters of the two walls 32 and 33, surrounding the insulation 33. The inner side plates 35 are straight, spaced, parallel members which define therebetween a linear portion of floor 29 over which successive objects to be dried, pass.

According to the present invention, opposed, outwardly curved, radiant emission walls 40 extend downwardly and outwardly from the inner wall **21*a* of top panel 13. Each of these walls 40 is formed of rectangular sheet metal, usually sheet metal which is deformed (bent) so as to provide at the upper edge of the wall 40, a top securing flange 41 secured to the lower surface of wall 21. Spaced, opposed, parallel, vertical flanges 42 extend downwardly from the inner edges of the securing flanges 41 and are thereafter bent respectively laterally outwardly, i.e., sidewise toward the panels 11 or 12, to form opposed, concaved, inwardly facing arcuate radiant emitter elements 43 which curve, generally, about spaced, horizontal, longitudinally extending axes which are above the floor 29**.

The lower end portion of the radiant walls 43 respectively terminate at the upper outer edges of the panels 30 in downwardly extending flanges 45 which are secured to the outer plates 35. The forward and rear edges of the radiant wall 40 are joined to the forward and rear ends of the side panels 11 and 12 by transversely extending end panels 45. Thus, a pair of transversely opposed, outer heat transfer chambers 46 are provided, these chambers being closed on their outer sides by the side panels 11 and 12 and on their top by the top panel 10. The outer chambers 46 are closed along the bottom by the panels 30 and along its inner portions by the walls 40. End panels 45 close both the front and rear ends of the chambers 46. The spaced walls 40 thus partially encompass from opposite side and curve around and define, therebetween, a central heating or curing chamber 80, the function of which will be described later.

The curvature of each radiant emission element 43 is generally arcuate in its vertical dimension, being concaved along its inner surface and convex along its outer surface throughout its vertical dimension. The curvilinear or vertical dimension, measured along the curved portion of the surface of element 43, should be greater than the height of object 81, i.e., one dimension of object 81 which extends generally in the same direction as the curved portion of wall 40. The length of element 43, i.e., longitudinally along the wall 40, should be greater than the longitudinal dimension of an object 81. Thus, the configuration factors ($F_a$) of the wall 40 with respect to the object 81 approaches a maximum.

The curvatures of the element 43 are all concaved along the inner surface but the radii of curvature varies so as to converge the rays of energy which are along such radii, toward the object 81 and distribute the concentration of radiant energy as uniformly over the area to be dried.

Figure 9:
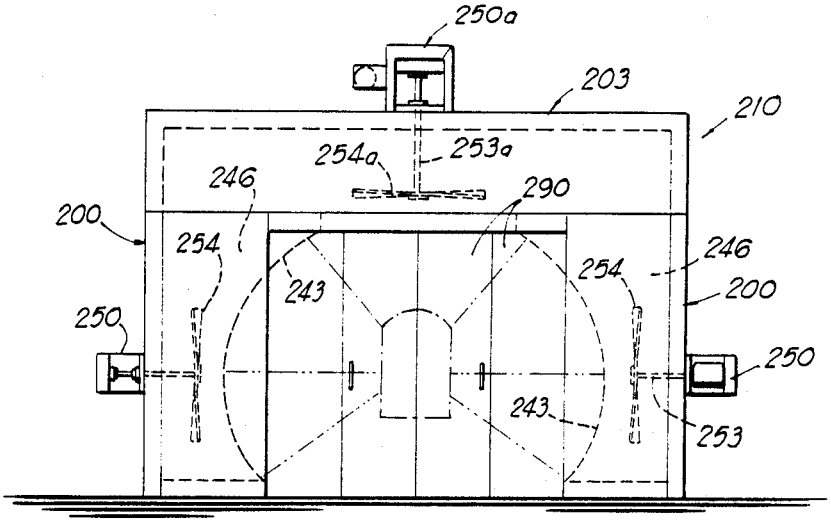
FIG. 9 is a view of a detail showing a modified form of the present invention.

The vertical dimension of elements 43 are thus each usually made up of a progressively changing arc formed primarily of segments or successive increments of circles and paraboles the radii of which vary and the parallel longitudinal axes of which also vary. In some instances the element 43 will be a portion of a cylinder or parabolic so that the radiation converges toward a common horizontal axis spaced in front of the element 43. The convergence of the energy directed radially, i.e., perpendicular to the tangent of the radiating increment will converge toward an imaginary tunnel extending longitudinally and above the floor 29 throughout the length of the oven. In FIG. 9, to be described hereinafter, the tunnel is indicated by the numeral 290 and the converging radiation by numeral 291.

The roof panel 13 is supported from floor panels 30 by upstanding columns or standards 44 which are within the outer chambers 46. These columns or standards 44 respectively adjacent to the rear or outer surfaces of radiant elements 43, intermediate portions of the elements 43 being secured to intermediate portions of the columns or standards 44 so that columns or standards 44 provide additional support for the walls 40.

Associated with each of the side panels 11 and 12 are a plurality of impellers, blowers, or fan assemblies, denoted generally by the numerals 50. These fan assemblies 50 each include an electric motor 51 supported by a motor mounting bracket 52, the motor 51 driving, through a belt or gear arrangement (not shown), a drive shaft 53. This drive shaft 53 is offset from the motor 51 and appropriately journalled solely by the bracket 52, as the case may be. The shaft 53 protrudes transvesely through a hole in the wall 11 or 12, as the case may be, and terminates inwardly of the inside surface or wall 16 of the panel 11 or 12. An impeller 54 in the form of a fan with radially outwardly extending blades is provided on the inner end of each shaft 53 so that it is rotated when the motor 51 is energized.

Preferably the shaft 53 is disposed about midway of the height of the wall panels 11 and 12. Preferably the shafts 53 are arranged in a common horizontal plane and are equally spaced longitudinally along the length of the housing 10. The fans 54 are thus disposed in a common parallel longitudinally extending vertical plane rearwardly of and facing elements 43 of walls 40, such fans 54 being positioned transversely centrally in the chambers 46 and their diameters being approximately equal to about ½ the height of the chamber 46. Other types of blowers or impellers can be substituted for assemblies 50 to violently agitate the air in the chambers 46 and maintain the air in a turbulent condition so that it impinges on the outer sides of the walls 40.

To prevent the vibration of motors 50 and fans 54 from being transmitted to the walls of housing 10, to thereby dislodge dirt, dust and deposits, therefrom, the mounting brackets 52 are perspectively supported directly from floor 29 by means of C-shaped upstanding support brackets 56 which are spaced outwardly from panels 11 and 12 and bolted by bolts 55 to floor 29.

Heating elements, denoted generally by the numeral 60, are disposed between adjacent pairs of the impeller assemblies 50. While the heating elements 60 can be electrical heating elements or any other heating element, in the present embodiment, they are each a gas burner assembly which includes a gas burner nozzle 61 carried by plate 62 mounted to the outer surface of the wall 11 or 12, as the case may be. Each nozzle 61 has an external blower 63 driven by an external motor 64 for introducing a combustible mixture of external air admixed with gas, through appropriate holes in panels 10 and 11, into the interior of the chamber 46. The nozzles 61 are disposed above the floor panels 30 and below the plane of the shafts 53.

Thus, when the oven is operating, the burners 60 will introduce the products of combustion into the outer chambers 46 at longitudinally spaced locations, the flames being directed transversely inwardly and the products of combustion being immediately caught up in the turbulent air generated by the fans 54. Therefore, with this rapidly swirling, heated air rapidly heats the radiant walls 40 and maintains them at a prescribed temperature.

In FIG. 3, the control means for the heating elements 60 is shown schematically as an electrical control panel 66 which contains appropriate electronic controllers, such as relays (not shown) which control the heating elements 60 via wires 66*a*, 66*b*, 66*c* and 66*d*. Wires 66*c* lead from panel 66 to thermocouples 67 affixed to radiant elements 43. The thermocouples 67 control the actuation and deactuation of elements 60 in a conventional manner, so as to maintain any prescribed temperature set at the panel 66.

The exhaust gases pass from chambers 46 through vents 57 at the lower portions of the arcuate elements 43 and then pass, in generally laminar flow, along the inner surfaces of the elements 43, moving upwardly and being exhausted by an exhaust blower assembly 70. The flow of hot gases along the inner surfaces of the wall elements 43 serves two main functions. First, these gases maintain the wall elements 43 in a hot condition, protecting them from cooling action by the air in the central heating chamber 80. Secondly, these gases, in cooperation with exhaust blower 70, remove the volatiles from chamber 80.

Ducts (not shown) for introducing hot gases, exhausted from other operations of a manufacturing plant, can be substituted for some or all of the heating elements 60, if desired. Also, the heating elements 60, if desired, may be wholly within the outer chambers 46, resting on panels 30.

The exhaust blower assembly 70 is on the top of panel 13 and includes an exhaust duct 72 mounted in the central portion of the top panel 13 of the housing 10. The suction end of this duct 71 communicates through a hole 72 in the central portion of the top panel 13, with the central heating chamber 80. The discharge end of the duct 71 discharges sidewise into the intake end of a centrifugal blower 73 which, in turn, is driven by a motor 74 through a belt 75 and a shaft 76. The motor 74 is supported on a bracket 77 mounted on the exterior of top panel 13. The blower 43 discharges through a discharge duct 78. The discharge duct 78 is provided with a damper 69.

The inner surfaces of the radiant walls 40 are coated with a porcelain enamel so that it radiates toward the central portion of the central chamber 80, directing the heat, which is transferred to it through the metal of the walls 40 toward vertical longitudinal centerline 84. This porcelain has high heat emitting characteristics (high emissivity), i.e., from about 0.9 to approximately 0.95, and forms a continuous emitter coating or surface film 79 for each of the walls 40. Other high emissivity materials can be substituted for the porcelain enamel forming these surface films 79.

Objects, items, parts or components, which have been freshly painted and contain wet paint along their exterior surface, are passed through the oven chamber 80 from the front end to the back end, along a prescribed path defined by centerline 84, the objects, such as object 81, being supported by any suitable carriage or conveyor 82 so as to be generally in the central portion of the inner chamber 80, as is it moved by the conveyor 82 progressively from one end to the other. It will be understood that there is essentially no appreciable turbulence within the central or inner chamber 80 and that this is essentially a zone of quiescence in which the air movement is maintained at a minimum.

Figure 11:
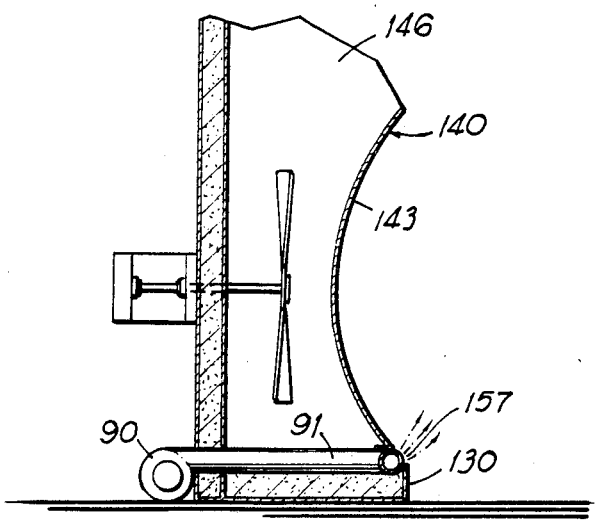
FIG. 11 is a fragmentary vertical sectional view of another modified form of the present invention.

In some instances, it may be found desirable to exhaust the products of combustion from the outer chambers 46, without such products of combustion passing into the inner chamber 80 since this may reduce the likelihood of particles of dirt or dust settling on the painted objects 81 which are being transported therethrough. In such instances the vents 57 are closed and vents (not shown) to the atmosphere lead directly from chambers 46. It is, however, desireable to substitute streams of air along the inside surfaces of the emitter elements 43. This is supplied, as shown in FIG. 11, by blowers, such as blower 90, which feed through a transverse duct or ducts 91 to longitudinal air ducts or headers, such as air header 92, carried by a panel 130, which are similar to panel 30. Each of the headers or ducts 92 is heated by air in the chamber 146, and discharged through holes 157 in the headers 92 at the bottom of the emitter elements 143 of the walls 140. Otherwise the oven is identical to oven 10. The headers or ducts 92 run, longitudinally, the length of each chamber 46.

With objects 81, such as automobile body parts coated with acrylic enamels currently being used in the automotive industry, the movement of such object 81 through the chamber 80 should take about six minutes, since by such time, the object will be sufficiently dry that dirt and dust will not accumulate thereon. Further drying may be under turbulent conditions, if desired and the present oven may be arranged in tandem with an oven on my U.S. Pat. No. 4,235,023, for further turbulent drying.

Figure 4:
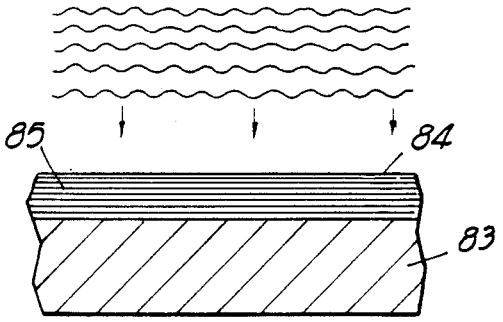
FIG. 4 is an enlarged schematic fragmentary sectional view of a piece of metal substrate containing wet paint and being depicted as being heated by radiant heat.
Figure 5:
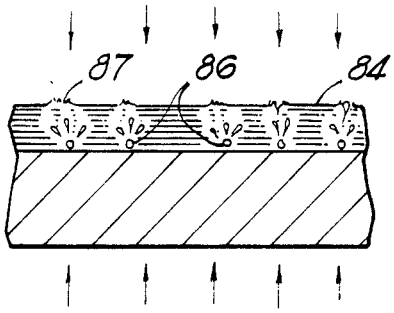
FIG. 5 is a view similar to FIG. 4 but illustrating the heating of the metal substrate with convection heating.

The advantage of the radiant heating, as opposed to convection heating; is illustrated in FIGS. 4 and 5. Here, a metal substrate 83 is illustrated as having a painted surface containing paint (enamel) 84 thereon. When this paint 84 is dried according to the present invention, as shown in FIG. 4, the radiant energy is directed against the painted surfaces and not the underside of the metal. Thus, the heat penetrates progressively from the surface, inwardly through the paint 84, so as to progressively dry the successive layers or increments 85 of the paint 84. This facilitates the progressive evaporation of the volatiles from the paint, without creating voids within the paint. This is particularly true of the enamel currently used in the automotive industry. In contrast, where such wet paints 84 are dried using convection heating, as shown in FIG. 5, the metal 83, as well as the paint 84 is heated so that the head tends to vaporize the solvent within the paint. As indicated at numerals 86, bubbles form under the skin created on the surface of the paint 84 and thereby generate blistering 87 as a result of the solvent passing outwardly.

Figure 8:
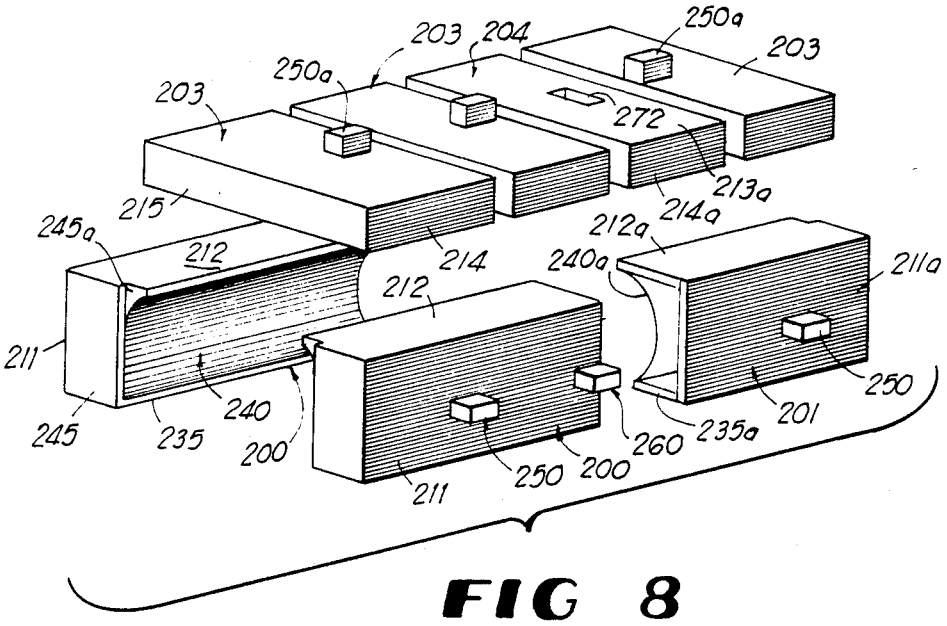
FIG. 8 is a schematic, exploded, perspective view of another embodiment of the present invention showing a modular, combined radiant heat and convection heat oven constructed in accordance with the present invention.
Figure 10:
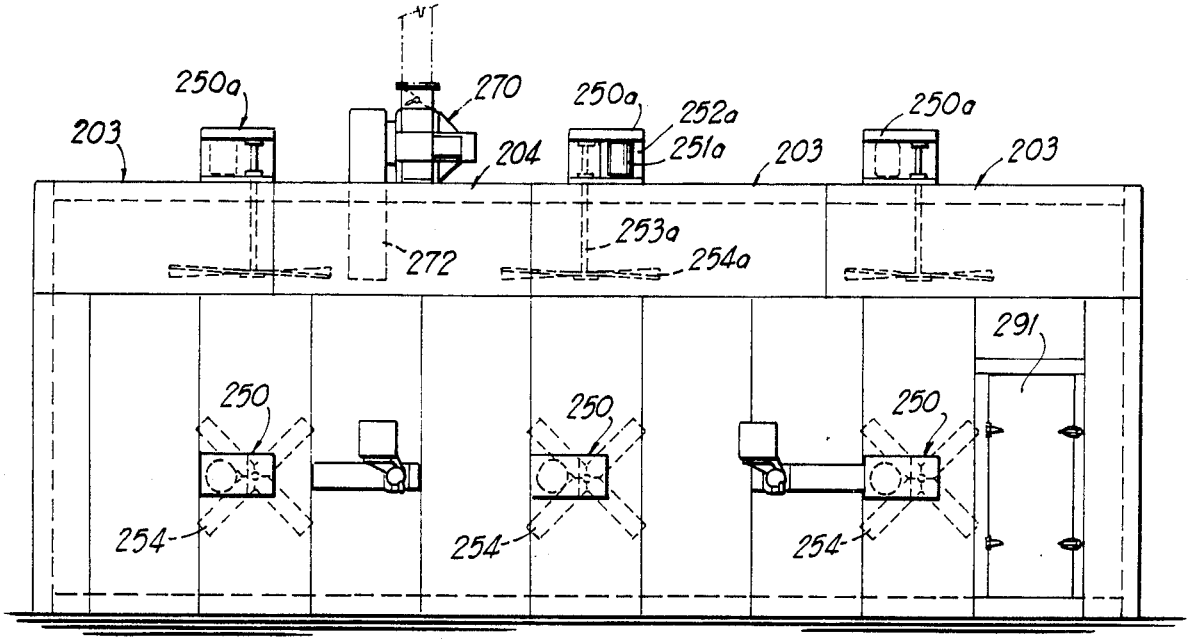
FIG. 10 is an end view of one end of the oven depicted in FIG. 9.

In the embodiment depicted in FIGS. 8, 9 and 10, a modified form of the present invention is illustrated wherein the oven or furnace serves the function of both a radiation oven and a convection oven. Furthermore, the structure shown in FIGS. 8, 9 and 10 is of modular construction so that it may be expanded, as desired. Thus, in drying the acrylic enamels discussed above, the oven can be operated purely as a radiant oven during the initial drying of objects and thereafter as a combination radiation and convection high turbulence oven.

The oven housing 210 has opposed complimentary left and right side modules 200 which are box like members having vertical side panels 211 and top panels 212. The housing 210 also includes bottom panels 235 and end panels 245, all being of double wall construction and having insulation, as depicted for sides 11 and 12 of the preceding embodiment. Radiant emitter walls 240 are provided on the inner sides of these side modules 200. The end panels 245 stop slightly inwardly of the upper portion of the walls 240 and therefore end plates **245*a* close the upper end portions of the modules 200 so as to form closures which form the outer chambers, as in the preceding embodiment. Air and fuel is introduced into the interior of the chambers or modules 200 by means of gas burners, such as gas burner 260. The burners or burner assemblies 260 are identical to the construction of the heating elements 60 and introduce flames inwardly into the chambers defined by the modules 200. Fan assemblies 250 are disposed on the back panels 211 so as to be interspersed with the burner assemblies, such as assembly 260**.

Another type of module 201 is also provided, this module having a blower assembly **250*a* which is identical to the blower assembly 250 and 50. The front end of this module 201 is left open, as is the rear end of the module 200 so that they can be fitted together to form a continuous side of the oven. This module 201 has a top panel 212*a*, a side panel 211*a* and a bottom panel 235*a* and a front wall 240*a*. When the walls 212, 212*a*, and 211, 211*a*, and 235, 235*a*** are brought into abutment and clamped together, they form the one side of the oven.

Disposed transversely across the top panels 212 and **212*a* of opposed pairs of modules 200 and 201 are a plurality of successive juxtaposed top modules 203 and 204. These top modules 203 and 204 each contain a top panel 213 and opposed side panels 214 and opposed end panels 215 which form a perimetal skirt extending downwardly from the edges of panel 213. Each panel is an insulative member similar to those panels described above. The top modules 203 rest on and are secured to the tops 212 and 212*a*, being supported by their lower edge portions so that the central portion of the panels 203 and 204 open downwardly communicating with the inner chamber 280, defined by the opposed pairs of walls 240 and 240*a***.

Located centrally in each of the top modules 203 is a top fan assembly **250*a* which has vertically disposed impeller shaft, such as shaft 253*a* seen in FIG. 10. This shaft 253*a* is journalled by a housing or bracket, such as bracket 250*a* on top panel 213. The bracket 250*a* supports a motor 251*a* which drives the shaft 253*a*. Each shaft 253*a* carries at its lower end a fan 254*a* which has radially extending blades disposed within the confines of the side panels 214 and 215. The bracket 252a which carries the motor 251a and the shaft 253a is mounted on the top of top panel 213. The above described top assembly 250a is illustrated only schematically in FIG. 8**.

The top module 204 is constructed, similarly to module 203, having a top panel 213a, opposed end panels 215a and opposed side panels 214a. A duct, denoted generally by the numeral 272, is built centrally into top panel 213a so that an exhaust blower, (not shown) similar to the blower 70 can be, and is connected to the duct 272 as shown in FIG. 10, for exhausting fumes from the interior of the oven. With the modules 200, 201, 203 and 204 appropriately assembled, the fans 254 of each fan assembly 250, are aligned in two parallel rows, outwardly of the two side walls 240, as seen in FIG. 9. The fan assemblies 250a are aligned along the centerline of the oven chamber 280 whereby the axes of the shafts 253a extend along the centerline downwardly so that the fans 254a are in a common horizontal plane above the open interior of chamber 280.

The walls 240 are spaced apart by a distance greater than the diameter of the fans 254a so that the fans, when operating, will direct air in a turbulent condition down against the objects passing between the walls 240. An exhaust blower 270 is provided for each of the modules 204, being connected to the duct 272, whereby air is withdrawn from the central chamber 280 between the walls 240. Preferably this exhaust system is arranged longitudinally between the top fan assemblies 250a as centrally as possible and where three fan assemblies 250a are employed, such as illustrated in FIGS. 8, 9 and 10, the exhaust should be between the second and the third fan assemblies 250a, as shown in FIG. 10.

Folding doors such as doors 290 can be provided on the front and back ends of the oven 210 so that the inner chamber can be closed by folding the doors 290 to a closed condition as depicted in FIG. 8. A side door, such as door 291 should be provided on the side of each back wall 211 so that access can be had to the interior of the outer chambers 246.

From a theoretical standpoint, net radiant exchange between two bodies, such as walls 40 and object 81, is governed by the following equation:

$$Q=\alpha F_e F_a A_1(T_1^4-T_2^4)\text{Btu/Hr.}$$

Where:

$Q$ = quantity of heat in Btu/hr. transfered $\alpha$ = Stefan-Boltzman Constant ($0.173\times10^{-8}$)

$F_e$ = Factor to allow for the departure of the two surfaces from complete blackness. A function of the emissivities $\epsilon 1$ and $\epsilon 2$.

$F_a$ = Configuration factor $A_1$ = The area of the absorbing surfaces within the TEC Radiant Walls 40.

$T_1$ = Temperature of the emitter.

$T_2$ = Temperature of the absorber.

From the above equation, the variables, which control the rate of heat transfer by radiation of the apparatus of the present invention, are the emissivities of the surfaces or films 79, the area of the absorbing surfaces of the object 81 and the temperature of the surfaces or films 79. The configuration of the process components 81, is fixed and the coating or paint on the object 81 to be cured or dried will have an emissivity that is usually not readily changeable. Therefore, the variables that can control the rate of infra-red radiant heat transfer are related to the geometry (configuration factor) and emitting surface temperature of the infra-red oven film 79.

Hottel has developed factors ($F_e$ and $F_a$) that can be used in equation A. While Hottel has developed factors for many special cases, in practical cases involving heat transfer by radiation the following Table I describes the factors that can be used.

TABLE I

| SURFACES BETWEEN WHICH RADIATION IS BEING INTERCHANGED | AREA A | $F_a$ | $F_e$ |
|---|---|---|---|
| 1 - Infinite parallel planes | $A_1$ or $A_2$ | 1 | $\dfrac{1}{\epsilon\frac{1}{1}+\epsilon\frac{1}{2}-1}$ |
| 2 - Completely enclosed body, small compared with enclosing body. (Subscript 1 refers to enclosed body). | $A_1$ | 1 | $\epsilon_1$ |
| 3 - Complete enclosed body, large compared with enclosing body. (Subscript 1 refers to enclosed body). | $A_1$ | 1 | $\dfrac{1}{\epsilon\frac{1}{1}+\epsilon\frac{1}{2}-1}$ |
| 4 - Intermediate case between 2 and 3. (Incapable of exact treatment except for special shapes). (Subscript 1 refers to enclosed body. | $A_1$ | 1 | $\epsilon_1 > F_e > \dfrac{1}{\epsilon\frac{1}{1}+\epsilon\frac{1}{2}-1}$ |

To assure that $F_a$ (configuration factor) is equal to the maximum of 1 in the described geometries, it is necessary that the radiating surface area equal or exceed the absorbing surfaces of the wet paint on an object 81. When this is accomplished, the radiation absorbed by the processed parts or components or object 81 becomes independent of the distance between the absorbing and emitting surfaces. In practical applications of heat transfer by infra-red radiation, the processed parts, i.e., object 81 can have variable surface configurations, such as an automobile or truck body. It would be impractical to build an infra-red radiant oven in which a constant distance between the emitting and absorbing surfaces could be maintained, if the surfaces of the object 81 were irregular in shape and size. This invention, however, provides an infra-red radiant heat transfer apparatus and process which will ensure that the configuration factor (a function of the configuration of the emitting surfaces and the processed part) approaches one. Since $F_e$ depends on emissivity of the absorbing and the radiating surfaces, it is important that the emitting surfaces 43 has good radiating ability, since the emissivity of the coating 79 on the surfaces of the part or component (object 81) being dried, is usually not variable.

The most practical material to build the radiating surfaces from is metal and since most metals have low emissivities, I have therefore coated the inside surfaces of the metal forming the heat transfer walls 40 and 240 with a material 79 that possesses a high emissivity. This invention, therefore, provides for the construction of the emitting surface to be from a metallic material, coated with a material that possesses a high emissivity, such as porcelain enamel which has an emissibility factor of about 9.3.

When monochromatic emissive power, $E_\lambda$ (Btu/r.-Sq. Ft.-$\mu$), is plotted against wave lengths, the spectral distribution of the total energy is represented by the curve shown in FIG. 7. In 1900, Planck introduced the Quantum theory, which enabled him to express the relationship between $E_\lambda$ (monocoromatic emissive power of a block body, Btu/Ft.$^2$-Hr.-$\mu$ and $\lambda$ (wave length, $\mu$) in such a manner that it exactly fits the values which had been previously determined from experimentation. Planck's equation has the form:

$$E = \frac{1.16 \times 10^8 \lambda - 5}{e^{25740/\lambda T} - 1}$$

Where:

$E_\lambda$ = Monochromatic emissive power of a black body. Btu/Ft.$^2$-$(Hr.)$ $(\mu)$ $\lambda$ = Wave length T = Temperature of the radiating black body °F. absolute e = Napierian base of logarithms which is numberically equal to 2.718

Planck's formula has been checked experimentally and theoretically and is accepted as an exact relationship among E,$\lambda$ and T for black body radiation.

A plot of Planck's equation varying the emitting surface temperature allows one to draw the following conclusions from the curve:

(1) An increase in temperature (T) causes a decrease in $\lambda$m, the wave length at which maximum energy emission occurs. The rate of energy emission at $\lambda$m is called $E$m.

(2) An increase in temperature causes a rapid increase in energy emission at any given wave length.

(3) The total rate of energy emission at any temperature and for any range of wave length is given by the area under the curve for that temperature taken over the wave length range being considered.

In practical application, infra-red radiation is not generated at one wave length. An examination of Planck's equation reveals that the radiation is generated over a span of wave lengths. Experimentation has shown that a family of long wave lengths is usually more readily absorbed into most surfaces than are the families of short wave lengths. In order to simplify the relationship between the emitting surface temperature and the family of wave lengths at which emission occurs, Table No. II will be used to demonstrate this relationship.

TABLE II

BLACK BODY THERMAL RADIATION - BTU/HR-FT$^2$
(1) IN VARIOUS WAVE LENGTH BANDS (QUALITY)
(2) TOTAL THERMAL RADIATION (QUANTITY)
(3) AND WAVE LENGTH AT MAXIMUM RADIATION

| Source Temp °F. | (1) WAVE LENGTH BAND - MICRONS 0–0.7 | 0.7–1 | 1–2 | 2–3 | 3–4 | 4–5 | 5–6 | 6–8 | 8–10 | 10+ | (2) Total Thermal Rad. | (3) Wave Length At Max. Rad. Microns |
|---|---|---|---|---|---|---|---|---|---|---|---|---|
| 500 | | | 1 | 27 | 99 | 155 | 174 | 308 | 215 | 482 | 1460 | 5.43 |
| 600 | | | 3 | 70 | 201 | 278 | 285 | 442 | 300 | 590 | 2170 | 4.92 |
| 700 | | | 12 | 162 | 376 | 445 | 414 | 620 | 376 | 705 | 3110 | 4.50 |
| 800 | | | 32 | 325 | 620 | 672 | 575 | 809 | 468 | 840 | 4340 | 4.14 |
| 900 | | | 76 | 576 | 963 | 952 | 752 | 1035 | 565 | 960 | 5880 | 3.84 |
| 1000 | | | 174 | 960 | 1400 | 1305 | 975 | 1250 | 660 | 1095 | 7820 | 3.57 |
| 1100 | | | 316 | 1525 | 1982 | 1628 | 1245 | 1510 | 765 | 1220 | 10,190 | 3.34 |
| 1200 | | 1 | 556 | 2250 | 2673 | 2053 | 1518 | 1763 | 876 | 1370 | 13,060 | 3.14 |
| 1300 | | 3 | 973 | 3200 | 3424 | 2550 | 1830 | 2010 | 1025 | 1483 | 16,500 | 2.96 |
| 1400 | | 8 | 1564 | 4404 | 4380 | 3090 | 2059 | 2340 | 1095 | 1650 | 20,590 | 2.80 |
| 1500 | | 18 | 2388 | 5960 | 5335 | 3600 | 2415 | 2640 | 1245 | 1780 | 25,380 | 2.66 |
| 1600 | | 34 | 3557 | 7720 | 6410 | 4340 | 2715 | 2910 | 1365 | 1920 | 30,970 | 2.53 |
| 1700 | | 71 | 5059 | 9840 | 7570 | 5050 | 3035 | 3215 | 1540 | 2060 | 37,440 | 2.41 |
| 1800 | | 126 | 7040 | 21,310 | | 5525 | 3450 | 3590 | 1620 | 2200 | 44,870 | 2.31 |
| 1900 | 5 | 225 | 9550 | 25,440 | | 6300 | 3840 | 3890 | 1760 | 2350 | 53,360 | 2.21 |
| 2000 | 12 | 13,090 | | 29,935 | | 11,210 | | 4220 | 1965 | 2455 | 62,990 | 2.12 |
| 2500 | 157 | 43,125 | | 58,650 | | 17,300 | | 6015 | 2500 | 3155 | 131,200 | 1.76 |
| 3000 | 1281 | 109,660 | | 96,850 | | 23,900 | | 7640 | 3205 | 3940 | 246,400 | 1.51 |
| 4000 | 20,415 | 405,560 | | 194,620 | | 38,110 | | | 21,780 | | 680,500 | 1.17 |
| 5000 | 129,900 | 1,005,400 | | 311,750 | | 51,950 | | | 29,030 | | 1,528,000 | 0.96 |

An examination of Table II reveals that, as the source temperature increases, the percentage of the total radiation rapidly increases at the shorter wave lengths. The total radiation per square foot also increases very rapidly as the emitting surface temperature is increased. In the present invention I have provided a radiant heat transfer system in which a large percentage of the radiation is emitted at the longer wave lengths which are more readily absorbed by the paint or other coatings being curved. I also maintain the total radiation in the radiant heat transfer system by greatly increasing the heat transfer area of the emitting surfaces as provided by walls 40. The expression that permits the calculation of the total emissive power of any body, if the temperature (T) and the emissivity are known is, as follows:

$$E=\epsilon\times 0.173\times 10^{-8}(T^4)$$

In a radiant heat transfer system, as the temperature of the emitting surface is decreased, the radiating surface can be increased to provide the same total radiant emission up to a limit. As an example, the total thermal radiation emitted from a surface temperature of 1000° F. is 7,820 Btu/Hr./Ft.$^2$. At a temperature of 500° F. the total radiation is only 1,460 Btu/Hr.Ft.$^2$. However, if 5.35 Ft.$^2$ of radiating area were used at the lower temperature the same total radiation would be produced that would occur at the higher temperature from a 1 Ft.$^2$. of emitting surface. Therefore, the same total radiation would be available for the radiant heat transfer system, but the spectral distribution would be shifted toward the longer wave lengths.

In the present invention, the geometry of emitting surfaces of the radiant walls 40 and 240 is for a dual purpose of (1) accomodating expansion and contractions; and (2) to insure that the radiation is directed toward an imaginary envelope or tunnel 290 defining the path of travel of the objects 80 through the oven 10 or 210 along the centerline. The radiant energy of maximum intensity is emitted normal to the curved surface of emitter elements 43 and 243. Thus, the curved surface of the radiant walls 40 or 240 are such that all the radiation normal to the emitting surface of elements 243, for example, will fall on this imaginary envelope or tunnel 290 that contains less surface area than the total of the radiating surfaces.

Obviously, radiation is emitted at all angles from the emitting surface of the radiant walls; however, the present system is designed so that the maximum intensity of such radiation is directed toward the radiant heat transfer envelope or tunnel 290 (since all other radiation is proportionate to the cosine of the angle to the surface), thereby insuring that the maximum radiation from the wall surfaces will fall upon the imaginary envelope or tunnel 290 through which the product or object 81 is passing.

The radiant heat transfer charcteristic of the radiant walls 40 and 240 with coatings such as coating 79 are summarized as follows:

(1) The spectral distribution is at the longer wave lengths as opposed to the shorter wave lengths of high intensity emitters. (More than ½ of the total radiation is 5 microns and greater).

(2) The internal geometry of the radiant wall 40 or 240 is such that the configuration factor $F_a$ is equal 1 or nearly equal 1.

(3) The emitting surface has a concave shape which will direct the maximum amount of radiation toward the imaginary envelope or tunnel 290 containing the objects 81 to be processed.

(4) The radiating walls 40 or 240 are constructed from a metallic material coated with a material of high emissivity, such as porcelain enamel.

In the embodiments here depicted, the outer chambers 46 and 246 are enclosed by the insulated walls by the side panels 11 and 12, the top panel 13 and bottom panels 30, for example, these walls being on all sides except for the radiating surfaces of walls 40 or 240. Chamber 46 and 246 are heated by hot gases which can be supplied from a remote source, such as waste gases from an incinerator, or it can be heated directly from a gas burner 50 or 250 or electric coils.

If hot gases were introduced into the chamber or cavity 46 or 246, the heat transfer to the radiant walls 40 or 240 would only be by free convection with a heat transfer coefficient of of 1 to 2 Btu/Hr.-Ft.$^2$/°F. Therefore, a means to create turbulence within the outer cavity or chambers 46 are provided by propeller fans 52 or 253. Turbulence does not have to be generated from a propeller fan, but can also be generated from a centrifugal type of fan, if desired. The purpose of generating turbulence in the heat transfer cavity or chamber 46 or 246 is to raise the forced convection heat transfer coefficient such that the air temperature can be lowered. The equation that describes the heat transfer by convection is as follows:

$$Q=h_f A(T_a-T_s)$$

Where:

Q=Btu/Hr./Ft.$^2$ or radiating surface $h_f$=Forced convection heat transfer coefficient $T_a$=Temperature of the air $T_s$=Temperature of the surface.

This equation readily demonstrates that if the forced convection heat transfer coefficient ($h_f$) is increased the temperature of the air within the cavity or chamber 46 or 246 can be decreased for the same heat transfer to the wall 40 or 240.

Figure 6:
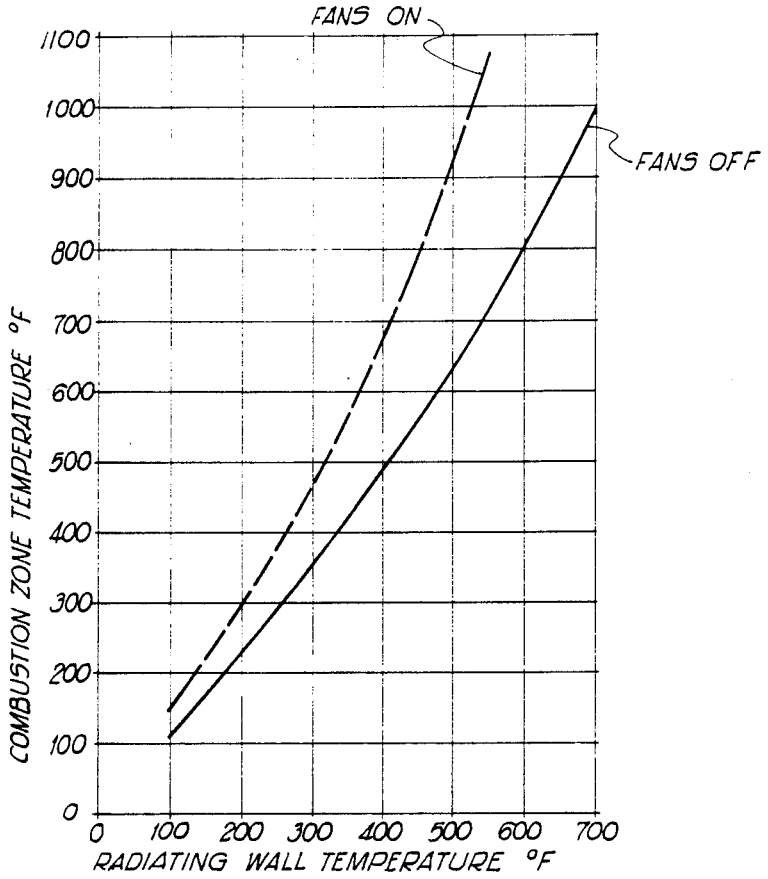
FIGS. 6 and 7 are graphs which illustrate the description of the present invention.

FIG. 6 illustrates the difference between using impellers, i.e., fans 54 or 253 and not using them and demonstrates the benefit of creating turbulence within the cavity or chamber 46 or 246. As an example, when the radiating coating 79 on wall 40 or 240 is operated at 400° F., the air temperature within the heat transfer cavity or chamber 46 or 246 needs to be only 490° F. Under the exact same conditions, if the fans 53 or 253 were not operated, the air temperature would have to be increased to 675° F. Benefits of operating the heat transfer cavity 46 or 246 at a lower temperature are obvious. If waste energy is being used, such as from an incinerator, it can be used at a lower temperature. If the heat is being generated within the heat transfer cavity or chamber 46 or 246, the transmission losses would be reduced and the general construction of the heat transfer cavity or chamber 46 or 246 would not be as complex at the lower operating temperatures. Without turbulence, for a radiant wall temperature of 525° F., an air temperature of 1,000° F. would be required. At this temperature to ensure reliability it would be necessary to fabricate the heat transfer cavity 46 or 246 from stainless steel. However, by using turbulence within the cavity 46 or 246 for the same surface temperature of 525° F. only 675° F. air temperature would be required. At these lower temperatures the heat transfer cavity or chamber 46 or 246 is fabricated from carbon steel or aluminized steel with minimum difficulty.

Another advantage of creating turbulence within the heat transfer cavity 46 or 246 behind the radiant wall 40 or 240 is to ensure uniform heat transfer to the radiant wall 46 or 246. The turbulent air behind the heat transfer wall 46 or 246 ensures that the radiating surface will operate at a uniform temperature because of the uniformity of the air temperature behind the wall. If turbulence were not created within the cavity 46 or 246, the radiant wall temperature could be uneven, being influenced by the high air temperatures because of bouyancy at the top of the heat transfer cavity or chamber 46 or 246.

It should be noted that the fans 54 or 254, to generate turbulence do not have to be side mounted, they can also be mounted in the top of the heat transfer cavity 46 or 246, if desired.

Openings or vents 57 at the bottom of the radiant wall 40 are to discharge hot gases at very moderate velocities (velocities that would not create any air movement in the heat transfer envelope or tunnel 290). It is not essential to discharge hot gases at vents 57 for the operation of the radiant wall oven, but hot gases at this point diffuse with the ambient air within the oven cavity or inner chamber 80 or 280 to prevent free convection cooling of the radiant surfaces of walls 40 and 240. During the process of free convection cooling, the colder air would contact the radiant wall elements 43 and 243 towards the bottom of the oven and as it was heated because of its increased bouyancy the heated air would continue up the radiant wall. By introducing the hot gases right at the bottom to be mixed with the colder air, the cooling effect from the ambient air within the oven cavity or central chamber 80 or 280 is essentially eliminated. It is not essential that the hot gases be discharged at these openings, however, if hot gases are not discharged, it is necessary to operate the radiant wall 40 or 240 at a slightly higher temperature to compensate for the energy that would be lost due to convection cooling.

Exhaust air is taken from the top of the radiant wall oven by exhaust blower 70 or 270, as in any type of oven and this air is replaced by the hot gases from the heat transfer cavities or chambers 46 and 246 that are discharged through vents 57.

In most applications, if the heat transfer cavity or chamber 46 or 246 is to be heated directly by gas burners 60 or 260, the combustion air for the burners 60 or 260 would be sufficient to provide proper dilution for the solvents within the central cavity or chamber 80 or 280. If under unusual circumstances, the combustion air blowers 50 and 250 did not provide sufficient dilution air, then additional fresh air should be introduced into the oven cavity or chamber 80 or 280 by a power blower (not shown). Obviously the exhaust fan or blower 70 or 270 would have to be sized to take care of the volume of the make-up air after it is heated.

The benefits of my radiant wall oven are thus summarized as follows:

(1) More than one-half of the total radiation emitted from a radiant wall oven is at a wave length of 5 microns or greater. Experimentation has shown that most coatings absorb the longer wave lengths more readily therefore, there is a technical benefit in emitting a large portion of the energy at the longer wave lengths as opposed to the high intensity units which emit most of their energy below 5 microns. Best U.S. Pat. No. 3,277,948 (Radiant Burner Utilizing Flame Quenching Phenomena) as an example, emits approximately 74% of its total energy at a wave length of 5 microns or less.

(2) The concave shape of the radiant walls elements 43 and 243 provide a geometry in which the maximum radiant intensity can be directed to an imaginary envelope or tunnel, such as tunnel 290, through which the freshly painted objects 80, i.e., processed parts are passed. This would not be possible with straight walls in that the maximum radiation would be directed to an imaginary plane exactly parallel to the straight section of the wall.

(3) The radiant wall oven is coated with a material that has a emissivity greater than 0.93 (within the range of 0.93 and (1) and the porcelain surface 79 greatly enhances the cleanliness of the oven because porcelain enamel is such an easy surface to keep clean.

(4) By incorporating turbulence in the cavity or outer chamber 46 or 246 in which the heat is transferred to the radiant wall, as in the structure shown in FIGS. 8 through 10, the air temperature can be substantially lowered below what it would normally be used if only free convection heat transfer were employed. Also, the turbulence insures uniform heat transfer to the radiant wall which insures uniform radiation temperatures.

(5) When a combination radiant wall/turbulation oven (FIGS. 8–10) is employed the same oven cavity can be used to accomplish both modes of heat transfer. Typically, the radiant wall section can be used in the initial cycle to dry the paint to a tack-free condition without any air movement which might carry dirt. After the paint is in a tack-free condition, the fans 254*a* in the top of the unit can then come on and the benefits of high turbulent heat transfer can be employed to ensure proper curing of all surfaces on the product to be finished. Actual production tests of ovens of this type in the automotive industry have shown that the stabilized temperature of an automobile body are within ±4° F. in this type oven.

(6) The configuration factor ($F_a$), because of the oven design, approaches 1 which results in the radiant heat transfer within the work area of the oven to be independent of distance. With a configuration factor of one, all surfaces of the part will absorb radiant heat more uniformly.

It will be obvious to those skilled in the art that many variations may be made in the embodiment chosen for the purpose of illustrating the present invention, without departing from the scope thereof, as defined by the appended claims.

I claim:

1. A radiant oven comprising:

(a) a housing having opposed side panels and a top panel extending between the upper ends of said side wall panels;

(b) spaced opposed radiant walls within said housing, said radiant walls being spaced inwardly from said side panels, said radiant walls having inner surfaces curving in opposite directions for defining therebetween a central heating chamber about which both of said wall are curved;

(c) means connected to said walls for forming outer chambers in which the walls define the inner portions of the outer chambers;

(d) means for providing, to said outer chambers, heated air for heating the outer surfaces of said walls to operating temperatures at which a majority of the radiant energy is emitted from the inner surfaces of said walls at wave lengths of 5 microns or greater.

2. The radiant oven defined in claim 1 including means for generating turbulent conditions in said heated air within said outer chambers for agitating said air for heating said radiant walls.

3. The radiant oven defined in claim 2 wherein said means for providing heated air includes a plurality of burners for introducing products of combustion into said outer chambers.

4. The radiant oven defined in claim 1 including a plurality of impellers disposed within said outer chambers for agitating the heated air therein.

5. The radiant oven defined in claim 1 including an exhaust blower mounted on said top panel and a duct communicating with the upper portion of said central chamber and said exhaust blower.

6. The radiant oven defined in claim 1 wherein said radiant walls are provided vents in the bottom portions thereof, and including exhaust means carried by said top panel and positioned laterally between said walls for exhausting air from the upper portion of said central chamber.

7. The radiant oven defined in claim 1 wherein said radiant walls are provided with inner surfaces composed of porcelain enamel.

8. The radiant oven defined in claim 1 including coating along said inner surfaces, said coating having an emissivity of between 0.9 and 1.

9. The radiant oven defined in claim 1, including an air impeller for directing air into said central chamber for generating turbulent conditions within said central chamber during a portion of the operation of said oven.

10. The radiant oven defined in claim 1 wherein said radiant walls extend substantially across the entire inner portions of said outer chambers and are curved so that heat generated by said radiant walls from positions perpendicular to the tangent of these walls converges toward a vertical plane along the center line of said central chamber.

11. The radiant oven defined in claim 1 wherein said means for providing said outer chambers with heated air includes a plurality of hydrocarbon fired burners, the burners being spaced longitudinally along said inner chamber and fan assemblies mounted on said walls and spaced longitudinally from each other.

12. A radiant oven comprising:

(a) a housing having opposed side panels and a top panel extending between the upper ends of said side wall panels;

(b) spaced opposed radiant walls within said housing, said radiant walls being spaced inwardly from said side panels, said radiant walls having inner surfaces curving in opposite directions for defining therebetween a central heating chamber about which both of said walls are curved;

(c) means connected to said walls for forming outer chambers in which the walls define the inner portions of the outer chambers;

(d) means for providing, to said outer chambers, heated air for heating the outer surfaces of said walls to operating temperatures at which a majority of the radiant energy is emitted from the inner surfaces of said walls at wave lengths of 5 microns or greater;

(e) said means for providing said outer chambers with heated air including a plurality of hydrocarbon fired burners, the burners being spaced longitudinally along said inner chamber and fan assemblies mounted on said walls and spaced longitudinally from each other: and (f) said fan assemblies being intersperced with said burners, each of said fan assemblies having a shaft protuding through its associated side panel, a motor exteriorially of said side panel and drive means connecting said motor to said shaft, the inner end of said shaft terminating between the side panel and the radiant wall, and a fan on the end of said shaft, said fan having radially extending blades and being rotatable by said shaft.

13. The radiant heat oven defined in claim 1 including a conveyor for moving successive objects along a linear path through said central chamber, said conveyor supporting each of said objects at an elevated position such that it is in position to receive radiation from both said radiant walls.

14. A radiant oven, for heating an object placed within said oven, comprising:

a housing defining an interior cavity, a radiant wall disposed within said cavity, said radiant wall having a curvature along one dimension thereof and being essentially linear along another dimension thereof whereby the radiant wall along its curved dimension provides a generally convex surface on one side and a generally concaved surface on the other side, means for heating said wall along its convex side, said concaved side defining a side portion of a chamber within said cavity for receiving said object, the curvilinear dimension of said radiant wall being greater than a first linear dimension of said object and the linear dimension of said wall being greater than another dimension of said object in a direction perpendicular to said first dimension and means for moving successive objects to be heated, in a longitudinal path of travel through said chamber and in front of said concaved surface, the linear dimension of said wall being generally parallel to said path of travel.

15. The radiant oven defined in claim 14 wherein said means for heating said wall includes for maintaining the temperature of said wall at a temperature such that a majority of the radiation emitted by said wall is generated at wave lengths of 5 microns or greater than five microns.

16. Process of drying paint on objects comprising:

arranging a pair of arcuate radiant emitter elements in spaced opposed relationship to each other whereby the inner surfaces of said opposed elements are generally curved about a central chamber in opposite directions, said elements having curvatures such that radiant heat, radiated inwardly from said inner surfaces and perpendicular to the tangent of successive increments of said elements, converge toward a central vertical plane through said central chamber, passing successive objects with wet paint thereon through said chamber along said plane, and heating said elements to a temperature sufficient that radiant energy is emitted from said elements toward said plane and regulating the temperature of the emitter elements so that a majority of the energy emitted from said elements is 5 microns or is emitted at wave lengths of 5 microns or greater.

17. The process defined in claim 16 including passing heated air along the inner surfaces of said elements under essentially laminar flow conditions so as to aid in maintaining said elements in a heat radiating condition.

18. The process defined in claim 17 including exhausting air from the top portion of said central chamber.

19. The process defined in claim 18 wherein the heated air is introduced along the lower portions of said elements and passes progressively upwardly therefrom and wherein the air is exhausted from the upper portion of said central chamber.

20. The process defined in claim 16 wherein the step of heating said elements includes enclosing the outer surfaces of said elements in outer chambers, directing products of combustion into said outer chamber and agitating the products of combustion within said outer chambers for generating turbulent conditions.

21. The process defined in claim 16 including a subsequent step of subjecting said objects to turbulent air conditions for further drying of said paint after said objects have been subjected to said radiant energy generated by said elements.

22. The process defined in claim 16 wherein the air in the central portion of said central chamber is maintained in an essentially non-turbulent condition.

23. The process defined in claim 16 wherein the inner surfaces of said elements are coated with a porcelain enamel to form inner coatings along substantially the entire inner surfaces, prior to heating said elements for radiating energy.

* * * * *

US004546553B1

REEXAMINATION CERTIFICATE (1975th)

United States Patent [19]

Best

[11] B1 4,546,553

[45] Certificate Issued Apr. 13, 1993

[54] RADIANT WALL OVEN AND PROCESS OF DRYING COATED OBJECTS

[75] Inventor: Willie H. Best, Columbia, S.C.

[73] Assignee: Haden Schweitzer Corporation

Reexamination Request:
No. 90/002,280, Feb. 11, 1991

Reexamination Certificate for:

| | |
|---|---|
| Patent No.: | **4,546,553** |
| Issued: | **Oct. 15, 1985** |
| Appl. No.: | **519,859** |
| Filed: | **Aug. 3, 1983** |

Related U.S. Application Data

[60] Continuation-in-part of Ser. No. 282,531, Jul. 13, 1991, Pat. No. 4,426,792, which is a continuation-in-part of Ser. No. 104,339, Dec. 17, 1979, abandoned, which is a division of Ser. No. 916,214, Jun. 6, 1978, Pat. No. 4,235,023.

[51] Int. Cl.[5] ..... F26B 3/28; F26B 23/10

[52] U.S. Cl. ..... 34/39; 34/68; 34/243 C; 118/642; 427/372.2

[58] Field of Search ..... 34/4, 39, 40, 41, 68, 34/243 C; 423/209, 212, 213, 148; 427/372.2, 444; 118/642, 643

[56] References Cited

U.S. PATENT DOCUMENTS 4,455,319 6/1984 Clark .
4,635,381 1/1987 Hubbert .

FOREIGN PATENT DOCUMENTS 1027502 5/1953 France ..... 34/4
1038813 10/1953 France .
432363 11/1964 Japan .

OTHER PUBLICATIONS

Touloukian, DeWitt, Hernicz, Thermal Radiative Properties Coatings, pp. 6 and 7, 1972, Exhibit 1.
Siegel, Howell, Thermal Radiation Heat Transfer, Second Edition, 1981 p. 157 Exhibit 2.
DeVries, French-English Science Dictionary, third edition, 1962, p. 505, Exhibit 4.
Baker, French-English English-French Dictionary, fifth edition, 1951, p. 505.
"Electric Infrared Technical Information", Bulletin #E-42; by Robert W. Jeffery—Fostoria-Fostoria-Fannon, Inc., 1961.
"Infrared Symposium"—Bulletin #E35—Fostoria--Fannon, Inc. 1961.
"Automotive Painting Systems" by Avon L. Newcomb, Pub. by AB Svenska Flaktfabriken, Stockholm 20, Sweden, reprint from SF Review 1961, published 1961.
"Flakten SF Review", vol. 6, 7, 1963-64, Publisher: Bengt Bert, Cover, Table of Contents & pp. 90-102.
"SF Paint Finishing Systems for the Automotive Industry", by Bertil Eliasson-Published by AB Svenska Flakt Fab, 1969.
Japanese Brochure entitled "dark infra-red oven"; English trans. of Japanese brochure entitled dark-infrared oven, Jun. 1969.
Drawings & Specification for Haden Oven Located at Ford Kansas City Plant (Defendant's Exbs. 51, 58 & 59-11).
Ford Oven Photographs, Jun. 1982.
Mark's "Standard Handbook for Mechanical Engineers", 8th Edition, by Baumeister, Avallon & Baumeister III, published by McGraw-Hill Book Company, 1916.
"Properties of Porcelain Enamels" by Wlm. E. Pierce, *Mat'ls in Design Engineering*, vol. 52, No. 1 (Jul., 1960) pp. 97-101.
"Selecting Porcelain Enameled Steels" by Charles M. Parker & Wlm. E. Pierce, *Mat'ls in Design Engrg*, vol. 60, No. 7, Reinhold Pub. Co., (Dec., 1964), pp. 92-99.
"A Designer's Guide to Vitreous Coatings" by Robert L. Stedfeld, *Machine Design*, vol. 24, No. 12, (Dec., 1952), pp. 165-172.
"Control of Radiant Heat by Surface Finish", by R. M. Leedy, Westinghouse Engineer, vol. 14, (Jul., 1954), pp. 147-151.
"What Nickel Penetrate is and Why you Should use it", 1980.

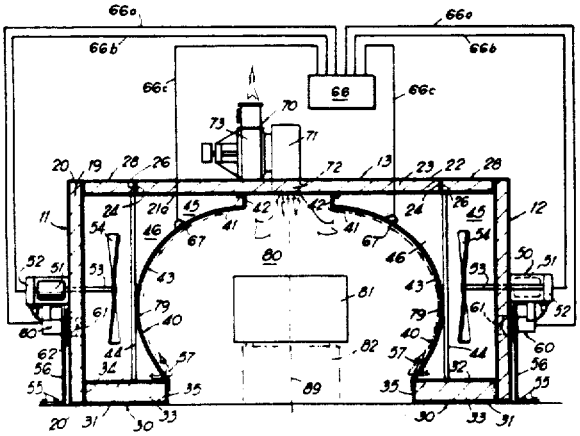

"Emissivity Test Data Report" by Square D. Company, Dated: Jan. 21, 1991.
Excerpts from Deposition of Charles Whitehead, pp. 1-6, & 17-20; Defendant's Exhibit 75—Copy of Ford Oven, Nov. 1990.
"Plaintiffs' Response to Defendant's First Request for Admissions"—Filed Dec. 8, 1990.
"Plaintiffs' Response to Defendant's Second Request for Admissions"—Filed Jan. 14, 1991.
"Chromalox Radiant Heaters" Emerson Electric Co., 1974, Manual PG-108-2.

*Primary Examiner*—Henry Bennett

[57] ABSTRACT

Radiant curved walls enclose opposite sides of a central heating chamber within which objects to be heated and dried are placed or passed along a path of travel. An insulated outer housing surrounds the radiant walls and defines, therewith, a pair of outer heating chambers. Heaters, carried by the outer housing, heat the air in the outer chamber and impellers in the outer chamber circulate that air so that it heats the radiant walls. Vents at the bottom portions of the radiant walls release air from the outer chamber to the inner chamber and an exhaust fan removes the air from the inner chamber. Radiation from the radiant walls heat and dry the objects, more than one-half the radiation being of a wave length of 5 microns or greater.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 5, lines 6-11:

The curvatures of the element 43 are all concaved along the inner surface but the radii of curvature varies so as to converge the rays of energy which are along such radii, toward the object 81 and distribute the concentration of radiant energy [as] uniformly over the area to be dried.

Column 10, lines 29-51:

TABLE 1

| SURFACES BETWEEN WHICH RADIATION IS BEING INTERCHANGED | AREA A | $F_a$ | $F_e$ |
|---|---|---|---|
| 1 Infinite parallel planes | $A_1$ or $A_2$ | 1 | [ $\dfrac{1}{\epsilon\frac{1}{1}+\epsilon\frac{1}{2}-1}$ ] $\dfrac{1}{\frac{1}{\epsilon_1}+\frac{1}{\epsilon_2}-1}$ |
| 2 Completely enclosed body, small compared with enclosing body. (Subscript 1 refers to enclosed body). | $A_1$ | 1 | [$\epsilon 1$] $\epsilon_1$ |
| 3 [Complete] *Completely* enclosed body, large compared with enclosing body. (Subscript 1 refers to enclosed body). | $A_1$ | 1 | [ $\dfrac{1}{\epsilon\frac{1}{1}+\epsilon\frac{1}{2}-1}$ ] $\dfrac{1}{\frac{1}{\epsilon_1}+\frac{1}{\epsilon_2}-1}$ |
| 4 Intermediate case between 2 and 3. (Incapable of exact treatment except for special shapes). (Subscript 1 refers to enclosed body. | $A_1$ | 1[ | $\epsilon 1 > F_\epsilon > \dfrac{1}{\epsilon\frac{1}{1}+\epsilon\frac{1}{2}-1}$ ] $\epsilon_1 > F_\epsilon > \dfrac{1}{\frac{1}{\epsilon_1}+\frac{1}{\epsilon_2}-1}$ |

Column 11, lines 9-18:

The most practical material to build the radiating surfaces from is metal and since most metals have low emissivities, I have therefore coated the inside surfaces of the metal forming the heat transfer walls 40 and 240 with a material 79 that possesses a high emissivity. This invention, therefore, provides for the construction of the emitting surface to be from a metallic material, coated with a material that possesses a high emissivity, such as porcelain enamel which has an emissibility factor of about [9.3] *0.93*.

Figure 7:
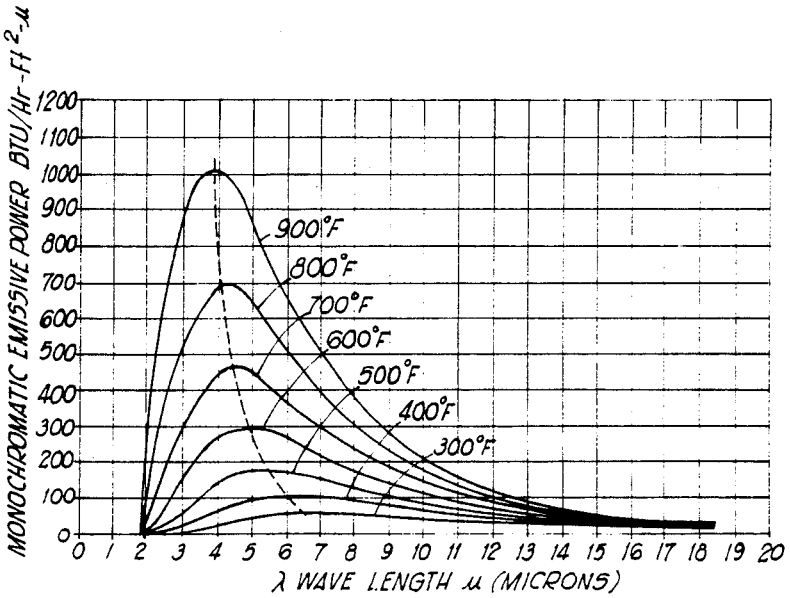

Column 11, lines 19-68:

When monochromatic emissive power, $E_\lambda$ ([Btu/r.-Sq.] *Btu/hr.-Sq.* Ft.-$\mu$), is plotted against wave lengths, the spectral distribution of the total energy is represented by the curve shown in FIG. 7. In 1900, Planck introduced the Quantum theory, which enabled him to express the relationship between $E_\lambda$ ([monocoromatic] *monochromatic* emissive power of a block body, Btu/Ft.$^2$-Hr.-$\mu$) and $\lambda$ (wave length, $\mu$) in such a manner that it exactly fits the values which had been previously determined from experimentation. Plank's equation has the form:

$$\left[E = \frac{1.16 \times 10^8 \lambda - 5}{e^{25740/\lambda T} - 1}\right]$$

$$E_\lambda = \frac{1.16 \times 10^8 \lambda^{-5}}{e^{25740/\lambda T} - 1}$$

Where:

$E_\lambda$ = Monochromatic emissive power of a black body. [Btu/Ft.$^2$-(Hr.)($\mu$)] *Btu/(Ft$^2$-Hr.-$\mu$)*

$\lambda$ = Wave length

T = Temperature of the radiating black body °F. absolute e = Napierian base of logarithms which is numberically equal to 2.718

Column 12, lines 1-3:

Planck's formula has been checked experimentally and theoretically and is accepted as an exact relationship among [E,$\lambda$] $E_\lambda$ and T for black body radiation.

Column 16, lines 1-5:

(3) The radiant wall oven is coated with a material that has a emissivity greater than 0.93 (within the range of 0.93 and [(] 1) and the porcelain surface 79 greatly enhances the cleanliness of the oven because porcelain enamel is such an easy surface to keep clean.

AS A RESULT OF REEXAMINATION, IT HAS BEEN DETERMINED THAT:

The patentability of claim 12 is confirmed.

Claims 1, 7–11, 13–16 are determined to be patentable as amended.

Claims 2–6 and 17–23, dependent on an amended claim, are determined to be patentable.
New claims 24–34 are added and determined to be patentable.

1. A radiant oven comprising:
(a) a housing having opposed side *wall* panels and a top panel extending between the upper ends of said side wall panels;
(b) spaced opposed radiant walls within said housing, said radiant walls being spaced inwardly from said side *wall* panels, said radiant walls having inner surfaces curving in opposite directions for defining therebetween a central heating chamber about which both of said [wall] *walls* are curved;
(c) means connected to said walls for forming outer chambers in which the walls define the inner portions of the outer chambers;
(d) means for providing, to said outer chambers, heated air for heating the outer surfaces of said walls to operating temperatures at which a majority of the radiant energy is emitted from the inner surfaces of said walls at wave lengths of 5 microns or greater.

7. [The radiant oven defined in claim 1 wherein] *A radiant oven comprising:*
*(a) a housing having opposed side wall panels and a top panel extending between the upper ends of said side wall panels;*
*(b) spaced opposed radiant walls within said housing, said radiant walls being spaced inwardly from said side wall panels, said radiant walls having inner surfaces curving in opposite directions for defining therebetween a central heating chamber about which both of said walls are curved;*
*(c) means connected to said walls for forming outer chambers in which the walls defined the inner portions of the outer chambers;*
*(d) means for providing, to said outer chambers, heated air for heating the outer surfaces of said walls to operating temperatures at which a majority of the radiant energy is emitted from the inner surfaces of said walls at wave lengths of 5 microns or greater; and*
(e) said radiant walls [are] *being* provided with inner surfaces composed of porcelain enamel.

8. [The radiant oven defined in claim 1 including] *A radiant oven comprising:*
*(a) a housing having opposed side wall panels and a top panel extending between the upper ends of said side wall panels;*
*(b) spaced opposed radiant walls within said housing, said radiant walls being spaced inwardly from said side wall panels, said radiant walls having inner surfaces curving in opposite directions for defining therebetween a central heating chamber about which both of said walls are curved;*
*(c) means connected to said walls for forming outer chambers in which the walls define the inner portions of the outer chambers;*
*(d) means for providing, to said outer chambers, heated air for heating the outer surfaces of said walls to operating temperatures at which a majority of the radiant energy is emitted from the inner surfaces of said walls at wave lengths of 5 microns or greater; and*
(e) a coating along said inner surfaces, said coating having an *emissivity of between 0.9 and 1 said inner surfaces converging the emitted rays toward an object disposed between said radiant walls.*

9. [The radiant oven defined in claim 1, including] *A radiant oven comprising:*
*(a) a housing having opposed side wall panels and a top panel extending between the upper ends of said side wall panels;*
*(b) spaced opposed radiant walls within said housing, said radiant walls being spaced inwardly from said side wall panels, said radiant walls having inner surfaces curving in opposite directions for defining therebetween a central heating chamber about which both of said walls are curved;*
*(c) means connected to said walls for forming outer chambers in which the walls define the inner portions of the outer chambers;*
*(d) means for providing, to said outer chambers, heated air for heating the outer surfaces of said walls to operating temperatures at which a majority of the radiant energy is emitted from the inner surfaces of said walls at wave lengths of 5 microns or greater; and*
(e) an air impeller for directing air into said central chamber for generating turbulent conditions within said central chamber during a portion of the operation of said oven *said inner surfaces converging the emitted rays toward an object disposed between said radiant walls.*

10. [The radiant oven defined in claim 1 wherein] *A radiant oven comprising:*
*(a) a housing having opposed side wall panels and a top panel extending between the upper ends of said side wall panels;*
*(b) spaced opposed radiant walls within said housing, said radiant walls being spaced inwardly from said side wall panels, said radiant walls having inner surfaces curving in opposite directions for defining therebetween a central heating chamber about which both of said walls are curved;*
*(c) means connected to said walls for forming outer chambers in which the walls define the inner portions of the outer chambers;*
*(d) means for providing, to said outer chambers, heated air for heating the outer surfaces of said walls to operating temperatures at which a majority of the radiant energy is emitted from the inner surfaces of said walls at wave lengths of 5 microns or greater; and*
(e) said radiant walls extend substantially across the entire inner portions of said outer chambers and are curved so that heat generated by said radiant walls from positions perpendicular to the tangent of these walls converges toward a vertical plane along the center line of said central chamber.

11. [The radiant oven defined in claim 1 wherein] *A radiant oven comprising:*
*(a) a housing having opposed side wall panels and a top panel extending between the upper ends of said side wall panels;*
*(b) spaced opposed radiant walls within said housing, said radiant walls being spaced inwardly from said side wall panels, said radiant walls having inner surfaces curving in opposite directions for defining therebetween a central heating chamber about which both of said walls are curved;*
*(c) means connected to said walls for forming outer chambers in which the walls define the inner portions of the outer chambers;*

(*d*) *means for providing, to said outer chambers, heated air for heating the outer surfaces of said walls to operating temperatures at which a majority of the radiant energy is emitted from the inner surfaces of said walls at wave lengths of 5 microns or greater; and*

(*e*) said means for providing said outer chambers with heated air includes a plurality of hydrocarbon fired burners, the burners being spaced longitudinally along said inner chamber and fan assemblies mounted on said walls and spaced longitudinally from each other.

13. [The radiant heat oven defined in claim 1 including] *A radiant oven comprising:*

(*a*) *a housing having opposed side wall panels and a top panel extending between the upper ends of said side wall panels;*

(*b*) *spaced opposed radiant walls within said housing, said radiant walls being spaced inwardly from said side wall panels, said radiant walls having inner surfaces curving in opposite directions for defining therebetween a central heating chamber about which both of said walls are curved;*

(*c*) *means connected to said walls for forming outer chambers in which the walls define the inner portions of the outer chambers;*

(*d*) *means for providing, to said outer chambers, heated air for heating the outer surfaces of said walls to operating temperatures at which a majority of the radiant energy is emitted from the inner surfaces of said walls at wave lengths of 5 microns or greater; and*

(*e*) a conveyor for moving successive objects along a linear path through said central chamber, said conveyor supporting each of said objects at an elevated position such that it is in position to receive radiation from both said radiant walls.

14. A radiant oven, for heating an object placed within said oven, comprising:

a housing defining an interior cavity, a radiant wall disposed within said cavity, said radiant wall having a curvature along one dimension thereof and being essentially linear along another dimension thereof whereby the radiant wall along its curved dimension provides a generally convex surface on one side and a generally *continuously* concaved surface on the other side *throughout its height for converging the rays emitted from said wall toward said object*, means for heating said wall along its convex side, said concaved side defining a side portion of a chamber within said cavity for receiving said object, the curvilinear dimension of said radiant wall being greater than a first linear dimension of said object and the linear dimension of said wall being greater than another dimension of said object in a direction perpendicular to said first dimension and means for moving successive objects to be heated, in a longitudinal path of travel through said chamber and in front of said concaved surface, the linear dimension of said wall being generally parallel to said path of travel.

15. The radiant oven defined in claim 14 wherein said means for heating said wall includes *means* for maintaining the temperature of said wall at a temperature such that a majority of the radiation emitted by said wall is generated at wave lengths of 5 microns or greater than five microns.

16. Process of drying paint on objects comprising:

arranging a pair of arcuate radiant emitter elements in spaced opposed relationship to each other whereby the inner surfaces of said opposed elements are generally curved about a central chamber in opposite directions, said elements having curvatures such that radiant heat, radiated inwardly from said inner surfaces and perpendicular to the tangent of successive increments of said elements, converge toward a central vertical plane through said central chamber, passing successive objects said elements, converge toward a central vertical plane through said central chamber, passing successive objects with wet paint thereon through said chamber along said plane, and heating said elements to a temperature sufficient that radiant energy is emitted from said elements toward said plane and regulating the temperature of the emitter elements so that a majority of the energy emitted from said elements is *at* 5 microns or is emitted at wave lengths of 5 microns or greater.

*24. A radiant oven for rapidly drying wet paint or coating on objects comprising:*

(*a*) *a housing having opposed side wall panels and a top panel extending between the upper ends of said side wall panels;*

(*b*) *spaced opposed radiant walls within said housing, said radiant walls being spaced inwardly from said side wall panels, said radiant walls having inner surfaces curving in opposite directions for defining therebetween a central heating chamber for receiving therebetween, said objects and about which both of said walls are curved;*

(*c*) *means connected to said walls for forming outer chambers in which the walls define the inner portions of the outer chambers;*

(*d*) *means for providing, to the inner surfaces of said walls, characteristics which enable said walls, when heated to operating temperatures to emit a majority of its radiant energy at wave lengths of 5 microns or greater converging toward said objects for rapidly drying the exterior surface of the wet paint or coating; and*

(*e*) *means for providing, to said outer chambers, heated air for heating the outer surfaces of said walls to operating temperatures at which said majority of the radiant energy is emitted from the inner surfaces of said walls at wave lengths of 5 microns or greater.*

*25. A radiant oven for drying wet paint or coating on vehicle body parts comprising:*

(*a*) *a housing having opposed side wall panels and a top panel extending between the upper ends of said side wall panels;*

(*b*) *spaced opposed radiant walls within said housing, said radiant walls being of greater height and width than any of said vehicle body parts, said walls being spaced inwardly from said side wall panels, said radiant walls having inner surfaces curving in opposite directions for defining therebetween a central heating chamber about which both of said walls are curved;*

(*c*) *means connected to said walls for forming outer chambers in which the walls define the inner portions of the outer chambers;*

(*d*) *means for providing, to the inner surfaces of said walls, characteristics which enable them to be heated to operating temperatures at which a majority of the radiant energy is emitted from the inner surfaces of said walls at wave lengths of 5 microns or greater converging toward said parts for rapidly drying the outer surface of said wet paint to a tack-condition; and*

(*e*) *means for providing, to said outer chambers, heated air for heating the outer surfaces of said walls to operating temperatures at which said majority of the radi-*

*ant energy is emitted from the inner surfaces of said walls at wave lengths of 5 microns or greater.*

*26. A radiant oven for drying wet paint or coating on automobile or truck bodies comprising:*

*(a) a housing having opposed side wall panels and a top panel extending between the upper ends of said side wall panels;*

*(b) spaced opposed radiant walls within said housing, each of said radiant walls having a height and width greater than one of said bodies, said radiant walls being spaced inwardly from said side wall panels, said radiant walls having inner surfaces curving in opposite directions for defining therebetween a central heating chamber for receiving at least, one of said bodies and about which both of said walls are curved;*

*(c) means connected to said walls for forming outer chambers in which the walls define the inner portions of the outer chambers;*

*(d) emitter means on the inner surfaces of said walls for providing to said inner surfaces an emissivity sufficient that when said walls are heated to a temperature sufficient to rapidly dry the surface of said paint, said emitter means will generate a majority of its radiation at wave lengths of five microns or greater;*

*(e) means for providing, to said outer chambers, heated air for heating the outer surfaces of said walls to operating temperatures at which said majority of the radiant energy is emitted from the inner surfaces of said walls at wave lengths of 5 microns or greater.*

*27. A radiant oven for drying wet paint or coating on automobiles or trucks comprising:*

*(a) a housing having opposed side wall panels and a top panel extending between the upper ends of said side wall panels;*

*(b) spaced opposed radiant walls within said housing, said radiant walls being spaced inwardly from said side wall panels, said radiant walls having inner surfaces curving in opposite directions for defining therebetween a central heating chamber about which both of said walls are curved;*

*(c) means connected to said walls for forming outer chambers in which the walls define the inner portions of the outer chambers;*

*(d) means for providing, to said outer chambers, heated air for heating the outer surfaces of said walls to operating temperatures at which a majority of the radiant energy is emitted from the inner surfaces of said walls at wave lengths of 5 microns or greater;*

*(e) said radiant walls having curvatures such that radiant heat, radiated inwardly from said inner surfaces and perpendicular to the tangent of successive increments of said radiant walls, for converges toward a central vertical plane through said central heating chamber; and*

*(f) means for passing successive of said automobiles or trucks with wet paint thereof through said chamber along said plane.*

*28. A radiant oven for drying wet paint or coating on automobile parts comprising:*

*(a) a housing having opposed side wall panels and a top panel extending between the upper ends of said side wall panels;*

*(b) spaced opposed radiant walls within said housing, said radiant walls being spaced inwardly from said side wall panels, said radiant walls having inner surfaces curving in opposite directions for defining therebetween a central heating chamber about which both of said walls are curved;*

*(c) porcelain coatings disposed along the curving portions of said inner surfaces of said radiant walls for providing to said inner surfaces an emissivity of between 0.9 and 1,*

*(d) means connected to said walls for forming outer chambers in which the walls define the inner portions of the outer chambers; and*

*(e) means for providing, to said outer chambers, heated air for heating the outer surfaces of said walls which are coated with porcelain to operating temperatures at which a majority of the radiant energy is emitted from the inner surfaces of said walls coated with porcelain at wave lengths of 5 microns or greater.*

*29. A radiant oven comprising:*

*(a) a housing having opposed side wall panels and a top panel extending between the upper ends of said side wall panels;*

*(b) spaced opposed radiant walls within said housing, said radiant walls being spaced inwardly from said side wall panels, said radiant walls having inner surfaces curving in opposite directions for defining therebetween a central heating chamber about which both of said walls are curved, each of said radiant walls having a curvature along a vertical dimension such that it is curving, being concaved along its inner surface and convex along its outer surface;*

*(c) means connected to said walls for forming outer chambers in which the walls define the inner portions of the outer chambers;*

*(d) means for providing, to said outer chambers, heated air for heating the outer surfaces of said walls to operating temperatures at which a majority of the radiant energy is emitted from the inner surfaces of said walls at wave lengths of 5 microns or greater;*

*(e) each of said radiant walls having radii of curvature for its vertical dimension curving about parallel longitudinal axes above said floor and within said central chamber, the length of said radii varying so as to converge the rays of energy emanating from the inner surfaces of said radiant walls toward said object within said central chamber for distributing the concentration of radiant energy generally uniformly over the area to be dried; the vertical dimension of said radiant walls being made up of progressively changing curvature formed primarily of successive increments whose said radii vary, the length of said axes being substantially throughout the length of said oven, the vertical dimension of each of said radiant walls being greater than the height of the objects to be dried; and the length of said walls being greater than the length of said objects to be dried; and*

*(f) a coating substantially along the entire curving inner surface of each of said radiant walls for imparting to said radiant walls an emissivity of within the range of from about 0.9 to about 1.0.*

*30. The radiant oven defined in claim 29 wherein said coating is porcelain enamel.*

*31. A radiant oven comprising:*

*(a) a housing with opposed side wall panels and a top panel extending between the upper ends of said side wall panels;*

*(b) spaced opposed radiant walls within said housing, said radiant walls being spaced inwardly from said side wall panels, said radiant walls having inner surfaces curving in opposite directions for defining therebetween a central heating chamber about which both of said walls are curved;*

(c) means connected to said walls for forming outer chambers in which the walls define the inner portions of the outer chambers;

(d) means for providing, to said outer chambers, heated air for heating the outer surfaces of said walls to operating temperatures at which a majority of the radiant energy is emitted from the inner surfaces of said walls at wave lengths of 5 microns or greater;

(e) the dimensions of said radiant walls being sufficiently large such that they generally surround substantially all of an automotive body which is passed through said oven; and (f) a porcelain enamel coating on the inner surfaces of said radiant walls, for providing said radiant walls with an emissivity of between 0.9 and 1.0 and from which a majority of the radiant energy is emitted from the inner surfaces thereof at wave lengths of 5 microns or greater.

32. A radiant oven, for heating and drying paint on an object placed within said oven, comprising:

a housing defining an interior cavity, a radiant wall disposed within said cavity, said radiant wall having a curvature along one dimension thereof and being essentially linear along another dimension thereof whereby the radiant wall along its curved dimension provides a generally convex surface on one side and a generally continuously concaved surface on the other side, a burner for heating said wall along its convex side, said means including a burner being generally coextensive with the linear dimension of said wall, said concaved side defining a side portion of a chamber within said cavity for receiving said object, the curvilinear dimension of said radiant wall being greater than a first linear dimension of said object and the linear dimension of said wall being greater than another dimension of said object in a direction perpendicular to said first dimension and means for moving successive objects to be heated, in a longitudinal path of travel through said chamber and in front of said concaved surface, the linear dimension of said wall being generally parallel to said path of travel.

33. The radiant oven defined in claim 32 including a porcelain coating adhered to said concaved surface.

34. A radiant oven for rapidly drying a wet paint or coating on an automotive body comprising:

(a) a housing having opposed side panels and a top panel extending between the upper ends of said side panels;

(b) spaced opposed radiant walls within said housing, said radiant walls being spaced inwardly from said side panels, said radiant walls having inner surfaces composed of porcelain enamel and curving in opposite directions for defining therebetween a central heating chamber for receiving therebetween said automotive body and about which both of said walls are curved;

(c) means connected to said walls for forming outer chambers in which the walls define the inner portions of the outer chambers; and (d) means for providing, to said outer chambers, heated air for heating the outer surfaces of said walls to operating temperatures at which a majority of the radiant energy is emitted from the inner surfaces of said walls at wave lengths of 5 microns or greater.

* * * * *